US005837657A

United States Patent [19]

Fang et al.

[11] Patent Number: 5,837,657

[45] Date of Patent: Nov. 17, 1998

[54] METHOD FOR REDUCING VISCOSITY INCREASE IN SOOTED DIESEL OILS

[76] Inventors: Howard L. Fang, 518 Glen Ridge South, Bridgewater, N.J. 08807; Jonathan M. McConnachie, 2 Prospects Hills, Apt. 1B, Flemington, N.J. 08822; Edward Ira Stiefel, 3 Glen Eagles Dr., Bridgewater, N.J. 08807

[21] Appl. No.: 982,681

[22] Filed: Dec. 2, 1997

[51] Int. Cl.[6] ..... C10M 135/00; C10M 139/00

[52] U.S. Cl. ..... 508/363; 508/362; 508/369

[58] Field of Search ..... 508/362, 363, 508/369

[56] References Cited

U.S. PATENT DOCUMENTS 4,392,966 7/1983 Schlict ..... 508/369

4,846,983 7/1989 Ward, Jr. ..... 508/363

4,978,464 12/1990 Coyle et al. ..... 508/363

*Primary Examiner*—Jacqueline V. Howard

*Attorney, Agent, or Firm*—Estelle C. Bakun

[57] ABSTRACT

The present invention is directed to a method for improving the performance of a sooted diesel oil and controlling soot induced viscosity increase by adding to a major amount of a diesel oil a minor amount of a composition comprising at least one compound having the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 10, Q is selected from the group of neutral electron donating compounds such as water, amines, alcohols, phosphines, and ethers, and z ranges from 0 to 5 and includes nonstoichiometric values.

18 Claims, 2 Drawing Sheets

METHOD FOR REDUCING VISCOSITY INCREASE IN SOOTED DIESEL OILS

FIELD OF THE INVENTION

The present invention relates to a method for extending oil drain intervals. More specifically, the method is directed to improving the wear performance of a sooted diesel oil and controlling soot-induced viscosity increase.

BACKGROUND OF THE INVENTION

Molybdenum disulfide is a well known lubricant. Unfortunately, its use as an additive in oils of lubricating viscosity is limited by its insolubility in oil. Consequently, oil-soluble molybdenum sulfur-containing compounds have been proposed and investigated for use as lubricating oil additives.

Commercially available dinuclear molybdenum sulfide lubricating oil additives are well known in the art. For example, the composition $Mo_2O_2S_2(dtc)_2$ can be added to a fresh oil of lubricating viscosity in order to enhance the oil's friction reducing properties. In the formula $Mo_2O_2S_2(dtc)_2$, dtc represents diorganodithiocarbamate ligands that are connected to the dinuclear molybdenum sulfide core.

High soot loadings in diesel oils are deleterious to the oil's performance. Soot can lead to significant viscosity increase, and high wear. Control of soot-induced viscosity increase becomes necessary to pass diesel lube engine tests. Furthermore, extension of engine oil drain intervals has become a major concern for heavy duty diesels.

Conventional wisdom teaches the addition of excessive amounts of dispersant to lubricants to control soot-induced viscosity increases. Such an approach is economically costly, leads to low temperature performance debits, and corrosion problems. Additionally, no recognizable benefit in wear performance is obtained using such an approach.

Consequently, there remains a need for a method that is capable of improving the performance of a sooted diesel oil extending oil drain intervals, and controlling soot induced viscosity increase and wear in diesel oils.

SUMMARY OF THE INVENTION

Figure 1:
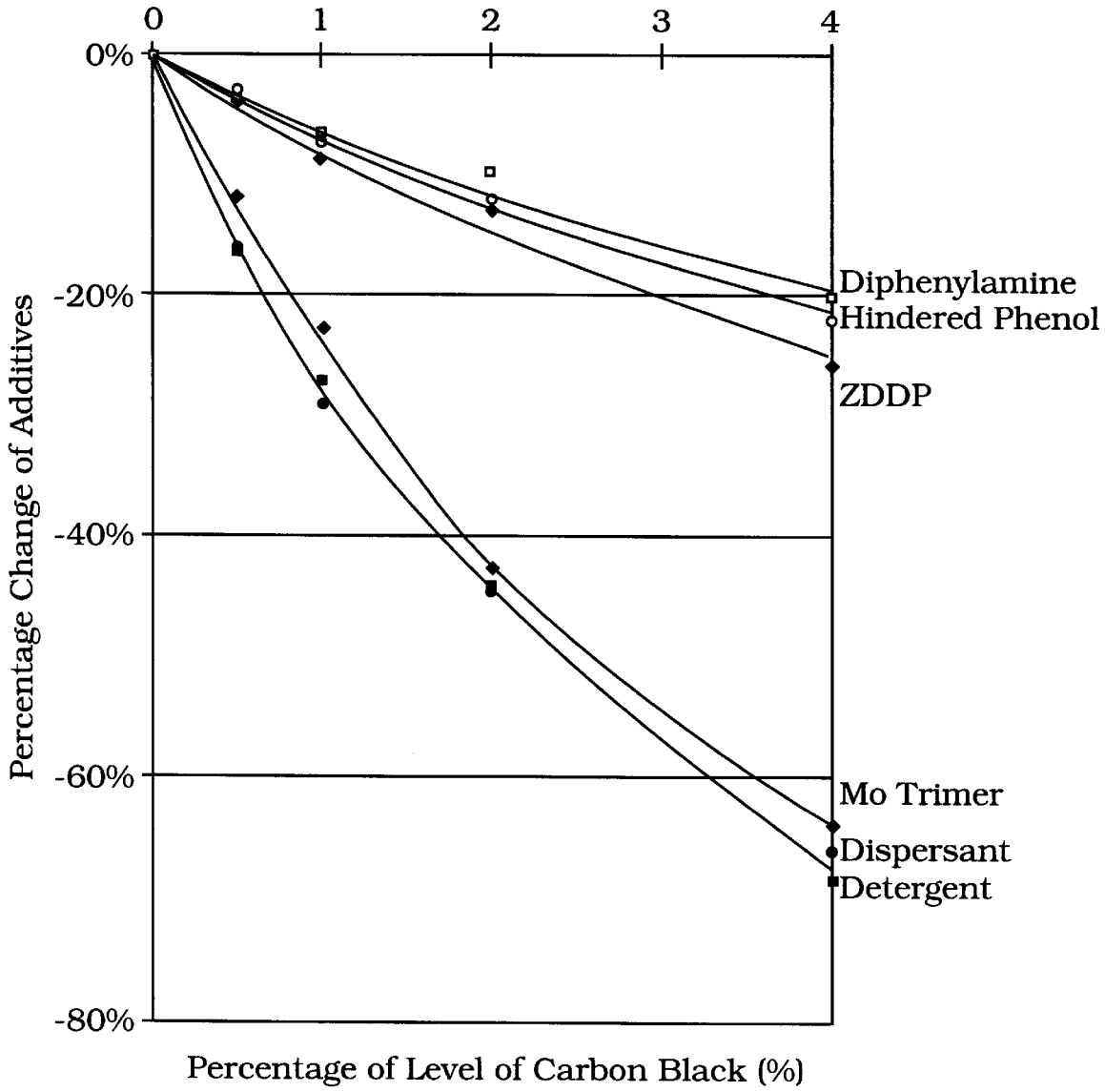
FIG. 1 shows the percentage loss of various additives in oil solutions containing different levels of carbon black. Percent carbon black (% CB) is shown on the x axis and percent change of additive (%Δ) on the y axis.

The present invention is directed to a method for improving the performance of a sooted diesel oil and controlling soot induced viscosity increase and wear by adding to a major amount of a diesel oil a minor amount of a composition comprising at least one compound having the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 10, Q is selected from the group of any neutral electron donating compounds. One skilled in the art can readily determine which compounds can be used as Q since Q is present to fill any vacant coordination sites on the molybdenum compound. For example, Q may be selected from water, amines, alcohols, phosphines, and ethers, and z ranges from 0 to 5 and includes non-stoichiometric values.

The ligands are independently selected from the group of

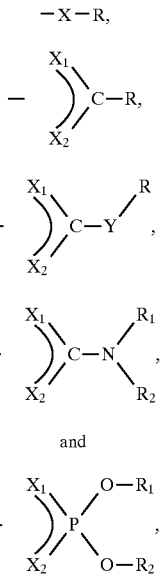

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different.

Sooted diesel oil as used herein means a diesel oil containing some level of soot. Diesel oil as used herein includes both sooted and unsooted diesel oil.

DETAILED DESCRIPTION OF THE INVENTION

The oil improved herein may be selected from any of the diesel lubricating oils. For example, the oils can range from light diesel to heavy duty diesel oils. The instant invention contemplates that the molybdenum compound can be added either prior to or post soot formation in the oil. A sooted diesel typically results from being subjected to operating conditions such as exposure to high shear forces, high temperature, a hostile chemical or physical environment, or similar conditions.

The molybdenum compounds utilized herein, also referred to as molybdenum trimers, are selected from compounds having the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 10, Q is selected from the group of any neutral electron donating compounds. One skilled in the art can readily determine which compounds can be used as Q since Q is present to fill any vacant coordination sites on the molybdenum compound. For example, Q may be selected from water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

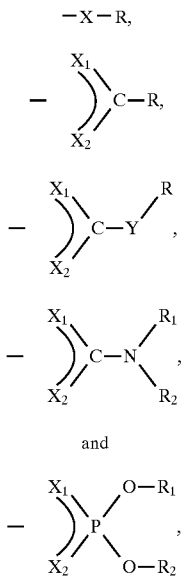

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group (e.g., alkyl, aryl, etc.). Preferably, the molybdenum compound utilized herein will have the $Mo_3S_7$ core.

Applicants believe, though not wishing to be bound, that the instant molybdenum compounds can effectively modify soot surfaces and form stable films on soot surfaces thereby reducing the soot-soot interactions resulting in resistance to soot scraping and improved wear performance thereby controlling viscosity increase. It is believed that the molybdenum compounds form molecules that interfere with soot agglomeration and alter film chemistry to reduce abrasive wear. It is further believed that the large alkyl groups of the adsorbed molybdenum compounds prevent further soot agglomeration while softening hard soot surfaces. The molybdenum compounds may further decompose under engine operating conditions to form antiwear films at the points of contact of engine surfaces.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.)

3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is the most preferred. Organic ligands containing two or more of the above functionalities are also capable of serving as ligands and binding to one or more of the cores. The compounds of the present invention require selection of ligands having the appropriate charge to balance the core's charge. Two or more trinuclear cores interconnected by means of one or more ligands are within the scope of the invention. Also within the scope of the invention are structures wherein oxygen and/or selenium are substituted for sulfur in the cores.

Compounds having the formula $Mo_3S_kL_nQ_z$ have cationic cores surrounded by anionic ligands and are represented by structures such as

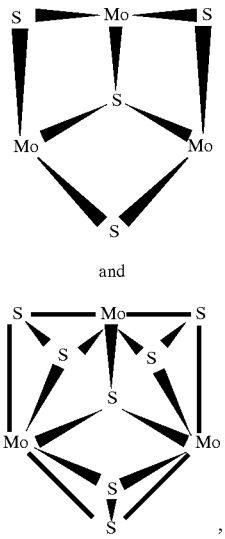

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate and, where required, a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as C1, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be for example aqueous or organic.

In general, the compounds prepared as outlined above can be purified by well known techniques such as chromatography and the like; however, it may not be necessary to purify the compounds. Crude mixtures that contain substantial amounts of the compound have been found to be effective.

A compound's oil solubility or dispersibility may be influenced by the number of carbon atoms in the ligands'organo groups. In the compounds of the present invention, at least 21 total carbon atoms should be present among all the ligands'organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The method of the instant invention contemplates utilizing a minor amount of the molybdenum compounds capable of improving the performance of a sooted diesel oil. Typically, the amount of molybdenum present in the molybdenum compound added to the diesel oil will range from a minor effective amount, preferably about 100 ppm to 2,000 ppm molybdenum from the trinuclear molybdenum compound, more preferably from 200 to 750 ppm, and most preferable from 300 to 500 ppm, all based on the weight of the lubricating composition.

Concentrates of the molybdenum compounds afford a convenient means of supply to the diesel oil. Thus, the molybdenum compounds of the present invention can be utilized in a suitable oleaginous carrier to provide a convenient means of handling the compounds before their use. Oils of lubricating viscosity, such as vegetable oil, mineral oil, animal oil, synthetic oil, or diesel oil itself can be used as a carrier as well as aliphatic, naphthenic, and aromatic hydrocarbons. These concentrates may contain about 1 to about 90 weight percent of the molybdenum compound based on the weight of the concentrate, preferably from about 1 to about 70 weight percent, and more preferably from about 20 to about 70 weight percent.

Other known lubricant additives may be compatible with the invention and can be present in the diesel oil being treated. These include for example friction-reducing agents, dispersants, single or mixed metal detergents, pour point depressants, viscosity improvers, antioxidants, surfactants, and antiwear agents. They can be present in amounts commonly utilized in the art. For example, beneficial lubricant additives containing phosphorous and/or sulfur compounds such as ZDDP may be contained in the sooted oils of the present invention.

It is also believed that the present invention prevents soot formation in the catalytic converter and combustion chamber. This is an added advantage and will keep the engine running more smoothly. In this instant, it is believed that the molybdenum acts as a combustion catalyst and reduces the formation of soot. In today's engines, oil bleed into the combustion chamber is continuous and needs to be burnt off. This process is referred to as "on-board-refining." Since the molybdenum trimers of the instant invention are attracted to soot, any soot that does form will immediately adsorb trimer which should help it combust and prevent soot formation.

The invention will be more fully understood by reference to the following examples illustrating various modifications of the invention which should not be construed as limiting the scope thereof. As used herein, ddp represents dialkyldithiophosphate and dtc represents dialkyldithiocarbamate.

EXAMPLES

Example 1 deals with the adsorption/binding behavior of moly-trimers with soot. Examples 2 and 3 deal with the wear benefit as well as its resistance to soot scraping using a conventional four-ball wear test.

Example 1

The adsorption of lube components onto soot surface is thought to be critical for soot-viscosity control, friction and wear. Dispersants are good in soot-handling because they can adhere to the soot surface and thereby interfere with soot particle agglomeration. We have quantitatively measured the partitioning equilibria for various additives on carbon black (CB) and on real engine soot. Differential IR combined with a filtration technique were used to quantify the additive loss in oil solution mixed with carbon black or engine soot. Fixed amounts of carbon black were blended in pure basestock with 1 percent weight of the additive of interest. Before doping carbon black into the oil, the IR spectrum was taken for each additive solution as a reference point. Another IR was then taken for the filtered oil. A comparison of the IR spectra before and after the filtration was analyzed to quantify the amount of additive absorbed on the soot surface.

FIG. 1 shows the percentage loss of common additives in solution containing different levels of CB. The data shows that the loss of additive in oil depends on the amount of the trapping material. The concentration dependence of adsorption loss for most additives follows the Langmuir isotherm and the additive content within oil is in equilibrium between trapping sites on soot surface and the additive concentration in solution. As shown in FIG. 1, moly-trimers show a high tendency to bind with CB. This binding is much stronger than with ZDDP additives or phenolics and is almost equivalent to the binding strength of CB with dispersant. A study of temperature dependence of the equilibrium constant provides the binding enthalpy for moly-trimer. The binding enthalpy was determined to be approximately 5 Kcal/mole.

Example 2

This example illustrates that $Mo_3S_7(dtc)_4$ layers adsorbed on the soot surface show anti-wear benefit toward soot scraping.

Figure 2:
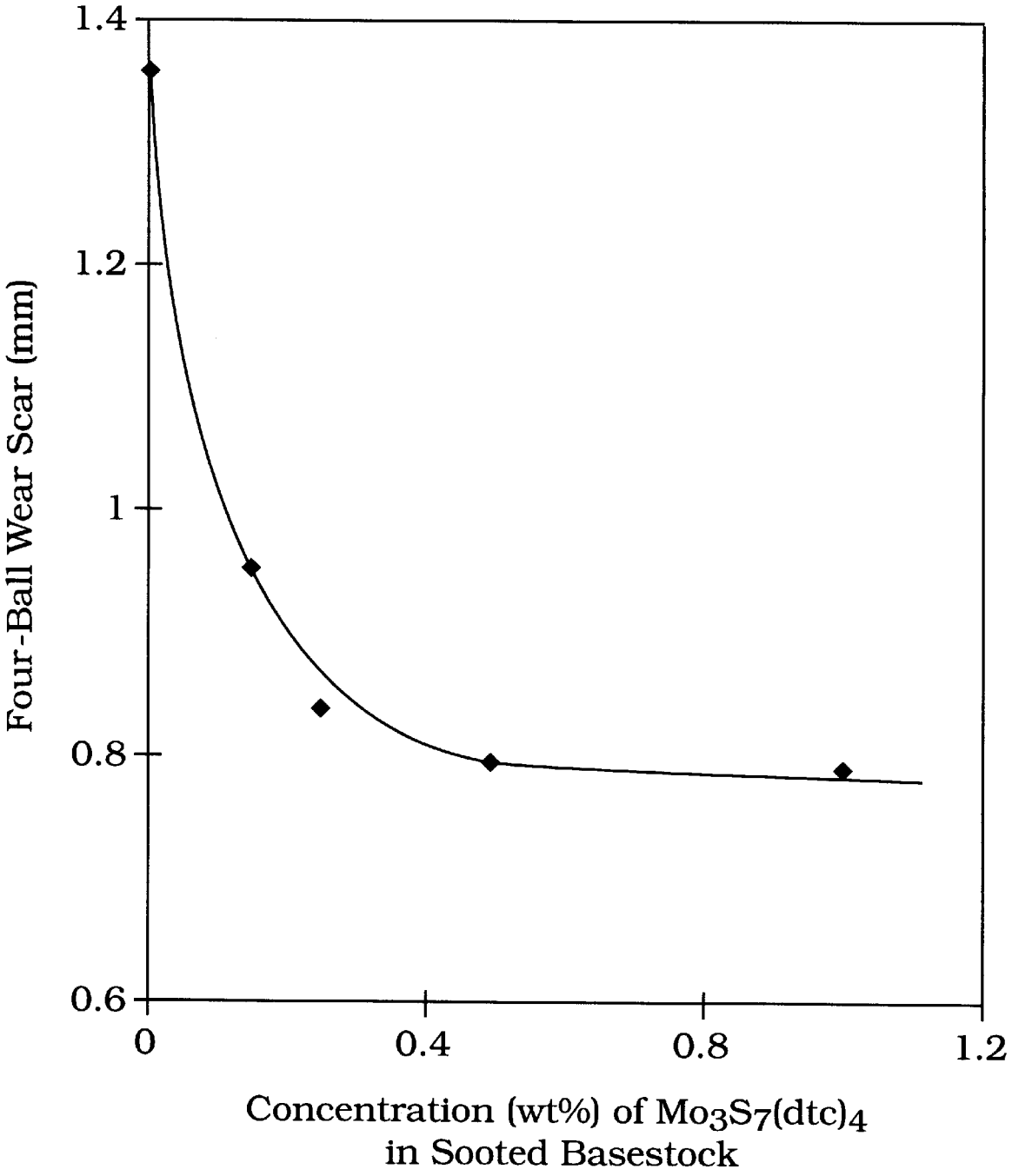
FIG. 2 shows the concentration dependence of wear response of molybdenum trimers in sooted basestock. Weight % $Mo_3S_7(dtc)_4$ in sooted basestock is shown on the x axis and Four-Ball wear scar (mm) on the y axis.

The wear performance of $Mo_3S_7(dtc)_4$ in basestock was evaluated with the four-ball wear test. The test conditions (60 Kg load, 1200 rpm speed, 45 minute at 100° C.) were similar to the ASTM D4172 method. FIG. 2 shows the wear response of different concentration levels of moly-trimer in sooted MCT30 (a diesel engine basestock) with a fixed 2.8 percent weight soot level. The sooted basestock was obtained by running a diesel GM6.2L engine with MCT30 alone (no additives). The 1 percent weight of $Mo_3S_7(dtc)_4$ in oil corresponds to a concentration of 1250ppm of [Mo].

As shown in FIG. 2, a beneficial wear response in sooted oil is observed when ~0.2 percent weight of moly-trimer is added. The response rapidly plateaus at higher concentrations. However, since molybdenum is lost during engine operation, higher concentrations of Mo are accepted.

Example 3

This example illustrates that $Mo_3S_7(dtc)_4$ films minimize soot abrasion. Under boundary conditions, rubbing surfaces become extremely reactive due to mechanical activity. Likewise, friction can initiate and accelerate chemical reactions that otherwise would not initiate at all or would take place at much higher temperatures. One possible mechanism involves the emission of low energy electrons from surfaces during friction. There is strong evidence that a non-metallic oxide layer is responsible for electron emission. These emitted electrons interact with anti-wear additive to generate negative ions or other anion/radical reactive intermediates, which are critical in anti-wear film formation. Trinuclear molybdenum compounds have a high tendency to adsorb on negatively charged metal surfaces and subsequently provide an effective way to deliver the formation of $MoS_2$. Moly-trimers such as $Mo_3S_7(dtc)_4$ consist of two types of ligands, three attached to individual moly sites and the other loosely attached to the tri-moly core. (The general structure can be presented by $Mo_3S_7(dtc)_3(dtc')_1$.) This fourth dtc ligand (the$(dtc')_1$ one) shows a high tendency to depart from the metal core and to leave an electrophilic complex which is highly susceptible for anion formation on the metal surface.

Table 1 lists the wear response of several samples in sooted MCT30 (all in 2.8 percent weight soot level): (A) 1 percent $Mo_3S_7(dtc)_4$, (B) basestock alone and (C) 0.5 percent $Mo_3S_7(dtc)_4$. In the presence of the moly-trimer, soot-induced wear is substantially reduced. This can be seen by the wear scar, which is reduced from 1.36 mm to 0.79 mm. The reduction is apparently caused by the formation of a stable friction/anti-wear film on the soot surface.

Soot particles were separated from the oil solution by centrifugation with a speed of 16 Krpm. After separation, the wear data for the top solutions are also improved from the base case. This is due to the remaining moly-trimers within the oil solution which can still provide anti-wear benefit. The wear response of dried out sooted precipitate from the centrifuge put back into MCT30 basestock with the appropriate amount of 2.8 percent weight soot. This indicates that there is a modification of the soot that presumably smoothes the surface for wear reduction. As shown in Table 1, a definite improvement against the base case (0.89 mm vs 1.36 mm wear scar) is observed. We conclude that the modified soot after re-dispersion are less harmful than the fresh soot in the base case without modification.

In case (C), after centrifugation, the wear scar of the sample redispersed into the basestock turns out to be much worse than the base case. Applicants believe that the reason that poor wear data is obtained for the 0.5 percent $Mo_3S_7(dtc)_4$ sample reintroduced into the basestock is that the soot was thoroughly washed with pentane to remove trimer on the surface which caused wear to increase. The removal of moly-trimers from soot surfaces with excessive pentane as well as the agglomeration process of the soot particles makes it difficult to redisperse the soot back into solution.

TABLE 1

Four-ball wear results in sooted MCT30 before and after centrifugal separation of soot

| Condition | | Four-Ball Wear Scar(mm) |
|---|---|---|
| (A) | 20% MCT30 + 80% sooted MCT30 (overall soot level 2.8% wt) | 1.36 |
| (B) | 20% MCT30 + 80% sooted MCT30 + 1% $Mo_3S_7(dtc)_4$ (overall soot level 2.8% wt) | 0.79 |
| The top solution after centrifugation (16 Krpm) of Solution (A) | | 1.00 |
| Separate the bottom precipitate of solution (A) with centrifugation; rinsed with C5, dried and reintroduced back into fresh MCT30 @ 2.8% wt | | 1.60 |
| The top solution after centrifugation (16 Krpm) of solution (B) | | 0.50 |
| Separate the bottom precipitate of solution (B) after centrifugation, rinsed with C5, dried and reintroduced back into fresh MCT30 @ 2.8% wt | | 0.89 |
| (C) | 20% MCT30 + 80% sooted MCT30 + 0.5% $Mo_3S_7(dtc)_4$ (overall soot level 2.8% wt) | 0.795 |
| The top solution after centrifugation (16 Krpm) of solution (C) | | 0.69 |
| Separate the bottom precipitate of solution (C) with centrifugation; rinsed with excessive C5, dried and reintroduced back into fresh MCT30 @ 2.8% wt | | 1.84 |

What is claimed is:

1. A method for improving the performance of a sooted diesel oil and controlling soot induced viscosity increase and wear and extending diesel engine oil drain intervals comprising adding to a major amount of a diesel oil a minor amount of a composition comprising at least one compound having the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 10, Q is a neutral electron donating compound selected from the group consisting of water, amines, alcohols, phosphines and ethers, and z ranges from 0 to 5 and includes non-stoichiometric values.

2. The method of claim 1 wherein Q the compound having the formula $Mo_3S_kL_nQ_z$ is oil dispersible.

3. The method of claim 1 wherein the compound having the formula $Mo_3S_kL_nQ_z$ is oil soluble.

4. The method of claim 1 wherein compound having the formula $Mo_3S_kL_nQ_z$ is selected from compounds having the formulas $Mo_3S_7(dtc)_4$, $Mo_3S_4(dtc)_4$, and mixtures thereof, wherein dtc represents independently selected diorganodithiocarbamate ligands.

5. The method of claim 4 wherein the ligands contain independently selected organo groups and wherein the ligands have a sufficient number of carbon atoms among all the ligands' organo groups to render the compound soluble or dispersible in the lubricating oil.

6. The method of claim 1 wherein the diesel oil is a sooted or unsooted oil.

7. The method of claim 1 wherein the compounds having the formula $Mo3S_kL_nQ_z$ comprise cores selected from the group of cores having the structures

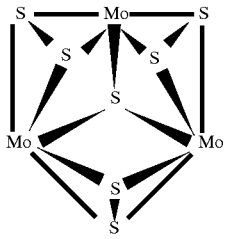

and

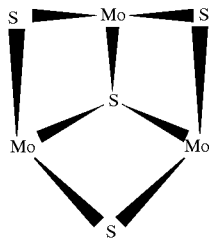

8. The method of claim 1 wherein the compounds having the formula $Mo_3S_kL_nQ_z$ contain ligands having the structure

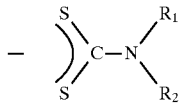

wherein $R_1$ and $R_2$ are independently selected from the group of hydrogen, and organo groups.

9. The method of claim 8 wherein the compound having the formula $Mo_3S_kL_nQ_z$ has a concentration by weight in the oil of from about 50 ppm to about 50,000 ppm based on the weight of diesel oil.

10. The method of claim 8 wherein the total number of carbon atoms among all the ligands' organo groups is at least 21.

11. The method of claim 8 wherein the organo groups are alkyl groups and the number of carbon atoms in each alkyl group ranges from about 1 to 30.

12. The method of claim 8 wherein the number of carbon atoms in each alkyl group ranges from about 4 to about 20.

13. The method of claim 1 wherein said diesel oil contains soot and wherein said compound having the formula $Mo_3S_kL_nQ_z$ forms a monolayer on the surfaces of said soot.

14. A method according to claim 1 wherein the amount of molybdenum contained in said compound having the formula $Mo_3S_kL_nQ_z$ is about 100 to about 2000 ppm.

15. The method according to claim 1 wherein the diesel oil is a sooted diesel oil (contains soot).

16. The method of claim 14 wherein the amount of said molybdenum contained in said compound having the formula $Mo_3S_kL_nQ_z$ is about 200 to about 750 ppm.

17. The method of claim 14 wherein the amount of said molybdenum contained in said compound having the formula $Mo_3S_kL_nQ_z$ is about 300 to about 500 ppm.

18. A method for controlling soot formation and accumulation in an engine's catalytic converter comprising using a catalyst comprising at least one compound having the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 10, Q is selected from the group of neutral electron donating compounds such as water, amines, alcohols, phosphines, and ethers, and z ranges from 0 to 5 and includes non-stoichiometric values.

* * * * *